US005249316A

United States Patent [19]

Macchiavello

[11] Patent Number: 5,249,316

[45] Date of Patent: Oct. 5, 1993

[54] BATHTUB DIVIDER

[76] Inventor: William A. Macchiavello, 5560 Rivendell Pl., Frederick, Md. 21701

[21] Appl. No.: 24,344

[22] Filed: Mar. 10, 1993

[51] Int. Cl.[5] ..... A47K 3/024

[52] U.S. Cl. ..... 4/559; 4/514; 4/572.1; 4/578.1; D6/353

[58] Field of Search ..... 4/514, 559, 505, 546, 4/547, 548, 571.1, 572.1, 578.1, 579, 586, 659, 573.1, 575.1; D23/303, 304; 297/257, 244, 232, 445, 452; D6/333, 339; D3/31

[56] References Cited

U.S. PATENT DOCUMENTS

| | | | |
|---|---|---|---|
| D. 252,765 | 8/1979 | Ziolkowski . | |
| D. 275,914 | 10/1984 | Gersin | D6/357 |
| D. 327,777 | 7/1992 | Tepper | 4/572.1 |
| 2,697,480 | 12/1954 | DuBas et al. | 4/572.1 |
| 3,528,111 | 9/1970 | Chou | 4/572.1 |
| 3,713,179 | 1/1973 | Dubiel . | |
| 3,976,328 | 8/1976 | Stahel | D6/333 |
| 4,117,558 | 10/1978 | Poth | 4/575.1 |
| 4,166,295 | 9/1979 | Schiron et al. . | |
| 4,295,683 | 10/1981 | Dubbink et al. | D6/333 |
| 4,472,844 | 9/1984 | Mace . | |
| 4,473,911 | 10/1984 | Germain . | |
| 4,574,406 | 3/1986 | Sutton et al. | 4/559 |
| 5,092,001 | 3/1992 | Ross et al. | 4/559 |
| 5,181,284 | 1/1993 | Raphael et al. | 4/572.1 |

FOREIGN PATENT DOCUMENTS

| | | | |
|---|---|---|---|
| 1260152 | 3/1961 | France | 4/559 |

*Primary Examiner*—Henry J. Recla
*Assistant Examiner*—Charles R. Eloshway

[57] ABSTRACT

An integral, one piece bathtub divider is designed to allow a parent to bathe a child or infant in the least amount of water possible. A seat portion is formed in front of a divider portion with the front of the divider portion forming a backrest for the seat portion. Two front wings are formed on either side of the backrest to act as armrests for a child. A top surface of the divider portion has a handle with two depressions formed on either side of the handle to allow a parent to lift the bathtub divider out of the bathtub after the child or infant has been bathed. A back portion is formed behind the divider portion with a container formed on a back surface of the divider portion and a bottom formed in the same manner as the seat portion behind the divider portion. Integral, inset suction cups are formed in a bottom surface of the seat portion and the bottom of the back portion.

12 Claims, 1 Drawing Sheet

BATHTUB DIVIDER

BACKGROUND OF THE INVENTION

1. Field of the Invention

The present invention relates to a divider for a bathtub to allow a parent to bathe a small child in the least amount of water possible.

2. Description of the Prior Art

Various dividers and dams have been constructed to direct water in a bathtub or toilet. U.S. Pat. No. 4,473,911, issued Oct. 2, 1984, to Sylvia A. Germain discloses a water dam for the rim of a bathtub which is intended to be fixed to the top surface of the bathtub rim to keep water inside the bathtub while a person is taking a shower.

U.S. Pat. No. 4,472,844, issued Sep. 25, 1984, to Ronald L. Mace discloses a tub shower seat which is made of molded waterproof plastic material which includes an integral hand bar.

U.S. Pat. No. 4,166,295, issued Sep. 4, 1979, to Klaus Schiron et al. discloses a swimming bath with dividers made of concrete which can be moved on rails by means of jack wheels or track rollers.

U.S. Pat. No. 3,713,179, issued Jan. 30, 1973, to Stephen Dubiel discloses a bathtub safety divider which provides a front divider to selectively shorten the tub to the user's size and reduce the risk of a user falling supine in the bathtub by providing an abutment for the feet.

U.S. Pat. No. Des. 252,765, issued Aug. 28, 1979, to Thomas J. Ziolkowski discloses the ornamental design for a water dam for a flush tank.

None of the above inventions and patents, taken either singly or in combination, is seen to describe the instant invention as claimed.

SUMMARY OF THE INVENTION

Accordingly, it is a principal object of the invention to provide a divider for a bathtub to allow a child or infant to be bathed by a parent in the least amount of water possible.

It is another object of the invention to provide a divider for a bathtub which has an integral seat portion, divider portion and container portion.

It is a further object of the invention to provide a divider for a bathtub where the seat portion is designed to hold a child or an infant in a seated position during bathing.

Still another object of the invention is to provide a divider for a bathtub where the bottom has integral, inset suction cups.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
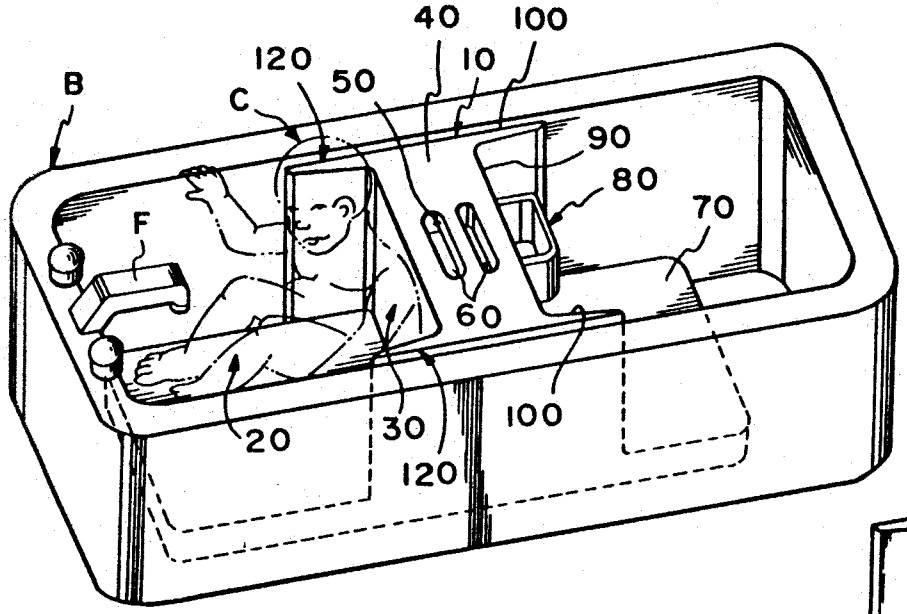
FIG. 1 is an environmental perspective view of the bathtub divider showing a child seated in the seat portion.

The present invention is an integral, one piece bathtub divider 10 which makes it possible to bathe a child C or an infant in the least possible amount of water. Referring to FIG. 1, the bathtub divider 10, which is made of one piece of resilient waterproof plastic, is press fit into the bathtub B with the seat portion 20.

The bathtub divider 10 is formed as wide as the bathtub B into which it is to be placed facing the faucet F. A seat portion 20 which is formed with enough space for a child C or an infant to sit in with a back portion 70 which is formed smaller so as to differentiate between the front and the back of the bathtub divider 10. A desired amount of water is then run to fill the seat portion 20 and a child C or an infant is placed in the seat portion 20. The backrest 30 of the seat portion 20 is formed by the divider portion 40 of the bathtub divider 10. A handle 50 is formed in the divider portion 40 with two depressions 60 formed on either side of the handle 50. The back portion 70 of the bathtub divider 10 is formed with a container 80. The container 80 is formed on the back 90 of the divider portion 40. The container 80 may be made by having a wall formed between the two back wings 100, by having an open-topped U-shaped box formed on the back 90 of the divider portion 40 of the bathtub divider 10, or by having netting strung between the two back wings 100.

Figure 3:
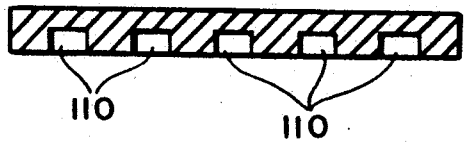
FIG. 3 is a section view drawn along lines 3—3 of FIG. 2 showing the integral, inset suction cups.
Figure 2:
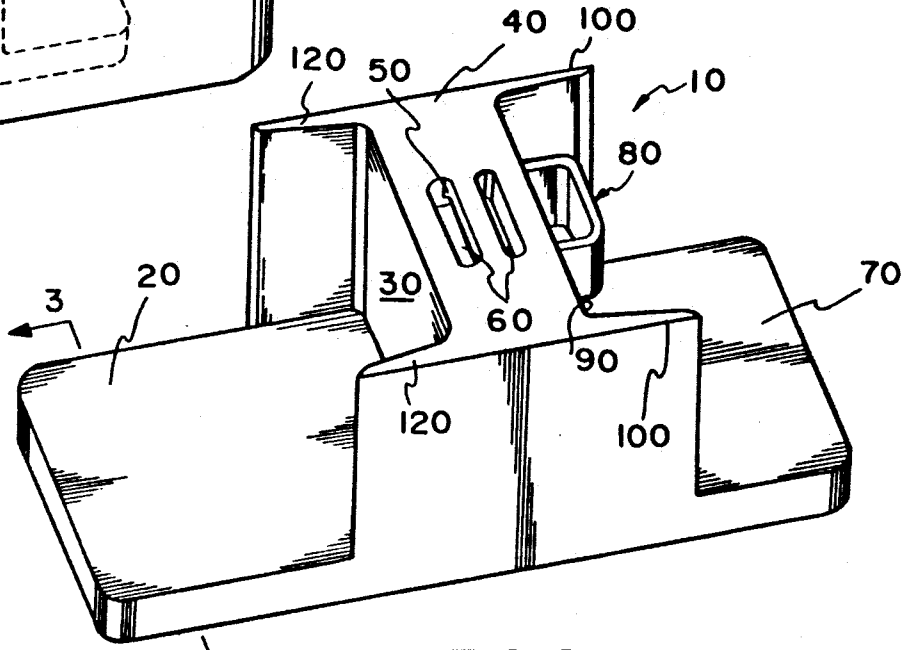
FIG. 2 is a perspective view of the bathtub divider.

Referring now to FIG. 3, integral, inset suction cups 110 are formed in the bottom of the bathtub divider 10 such that the bathtub divider 10 is held firmly to the bottom of the bathtub B without any possibility of water flowing under the bathtub divider 10, causing the bathtub divider 10 to float. Referring back to FIGS. 1 and 2, on either side of the backrest 30 of the divider portion 40 are formed front wings 120 which may be used by a child C as arm rests.

After the parent has finished bathing the child C or infant, the parent lifts up on the handle 50 to lift the bathtub divider 10 out of the bathtub B.

It is to be understood that the present invention is not limited to the sole embodiment described above, but encompasses any and all embodiments within the scope of the following claims.

I claim:

1. An integral, one piece bathtub divider comprising:

a seat portion having a backrest portion;

a back portion;

a divider portion being formed between said seat portion and said back portion;

said divider portion having a container formed thereon;

said container being formed on a back surface of said divider portion;

said backrest portion having two front wings formed thereon;

said back surface of said divider portion having two back wings formed thereon;

one of said front wings being formed on a left side of said backrest portion;

another of said front wings being formed on a right side of said backrest portion;

one of said back wings being formed on a right side of said back surface of said divider portion;

another of said back wings being formed on a left side of said back surface of said divider portion; and integral, inset suction cups being formed on a bottom surface of said bathtub divider, whereby said bathtub divider allows a parent to bathe a child or infant in the least amount of water possible.

2. The bathtub divider according to claim 1, wherein said bathtub divider is formed on a resilient waterproof material.

3. The bathtub divider according to claim 2, wherein said bathtub divider is formed as wide as a bathtub into which said bathtub divider is to be placed.

4. The bathtub divider according to claim 3, wherein a handle is formed on a top surface of said divider portion.

5. The bathtub divider according to claim 4, wherein two depressions are formed in said top surface of said divider portion;

one of said two depressions being formed in front of said handle; and another of said two depressions being formed behind said handle.

6. The bathtub divider according to claim 2, wherein a handle is formed on a top surface of said divider portion.

7. The bathtub divider according to claim 6, wherein two depressions are formed in said top surface of said divider portion;

one of said two depressions being formed in front of said handle; and another of said two depressions being formed behind said handle.

8. The bathtub divider according to claim 1, wherein said bathtub divider is formed as wide as a bathtub into which said bathtub divider is to be placed.

9. The bathtub divider according to claim 8, wherein a handle is formed on a top surface of said divider portion.

10. The bathtub divider according to claim 9, wherein two depressions are formed in said top surface of said divider portion;

one of said two depressions being formed in front of said handle; and another of said two depressions being formed behind said handle.

11. The bathtub divider according to claim 1, wherein a handle is formed on a top surface of said divider portion.

12. The bathtub divider according to claim 11, wherein two depressions are formed in said top surface of said divider portion;

one of said two depressions being formed in front of said handle; and another of said two depressions being formed behind said handle.

* * * * *